United States Patent [19]

Suzuki et al.

[11] 4,028,129

[45] June 7, 1977

[54] HEAT-DEVELOPABLE PHOTOSENSITIVE MATERIALS

[75] Inventors: Nobuo Suzuki; Yasuhiro Noguchi; Takao Masuda, all of Asaka, Japan

[73] Assignee: Fuji Photo Film Co., Ltd., Minami-ashigara, Japan

[22] Filed: Jan. 8, 1975

[21] Appl. No.: 539,566

[30] Foreign Application Priority Data

Jan. 8, 1974 Japan ..... 49-5453

[52] U.S. Cl. ..... 96/114.1; 96/48 HD; 96/56; 96/66 T; 96/114.6

[51] Int. Cl.² ..... G03C 1/02; G03C 1/76

[58] Field of Search ..... 96/114.1, 56, 114.6, 96/66 T, 48 HD, 109, 110

[56] References Cited

UNITED STATES PATENTS

| | | | |
|---|---|---|---|
| 3,152,904 | 10/1964 | Sorensen et al. | 96/114.1 X |
| 3,457,075 | 7/1969 | Morgan et al. | 96/114.1 |
| 3,589,903 | 6/1971 | Birkeland | 96/66 T |
| 3,798,039 | 3/1974 | Leclair | 96/114.1 |

OTHER PUBLICATIONS

Mees–The theory of the photographic process Macmillan Co. 1954 pp. 540–541, 741–743.

*Primary Examiner*—Thomas J. Herbert, Jr.
*Attorney, Agent, or Firm*—Sughrue, Rothwell, Mion, Zinn & Macpeak

[57] ABSTRACT

A heat-developable photosensitive material which comprises a support having one or more layers thereon containing at least (a) an organic silver salt, (b) a catalytic amount of a photosensitive silver halide or a component capable of forming a photosensitive silver halide, (c) a reducing agent and (d) at least one of an inorganic peroxide and a peroxodisulfate.

15 Claims, No Drawings

HEAT-DEVELOPABLE PHOTOSENSITIVE MATERIALS

BACKGROUND OF THE INVENTION

1. Field of the Invention

The present invention relates to heat developable photosensitive materials. Particularly, it relates to heat developable photosensitive materials having less heat fog and good whiteness.

2. Description of the Prior Art

The photographic process using silver halides has been most widely practiced hitherto, because excellent photographic properties such as good sensitivity or gradation can be obtained in this process as compared with other photographic processes such as an electrophotographic process or a diazo photographic process. However, silver halide photosensitive materials used in this process are subjected to development using a developer after image exposure and then subjected to processings such as stopping, fixation, water washing or stabilization so as to prevent the developed images from fading or discoloration under normal room illumination to prevent the undeveloped areas (hereinafter called background) from blackening. Accordingly, these processings take much time and are labor some. Further, there are problems in that the handling of the chemicals used is dangerous to the human body or the hands and clothes of the workers and the processing room are stained at processing. Thus, it is very desired to improve the photographic process using silver halides so that the processings can be carried out in a dry manner without using solution processing and the processed images can be preserved in a stabilized state.

Therefore, many approaches to achieve such have been attempted hitherto. One approach is to use heat developable photosensitive materials as described in U.S. Pat. Nos. 3,152,904, 3,457,075, 3,635,719, 3,645,739, and 3,756,829, Canadian Patent 811,677. This approach is to use a photosensitive element wherein silver salts, for example, silver salts of higher fatty carboxylic acids such as silver behenate, silver saccharin or silver benzotriazole are used as a main component and a catalytic amount of silver halide is used.

However, in these heat developable photosensitive materials, the quality of the resulting image is not good because of heat fog, namely, undesirable fog occurs to a very high degree when the nonexposed area is heated. Further, undesirable residual color of color compounds, for example, residual dyestuffs adsorbed in silver halide occur. This residual color injures the quality of the resulting image.

As a technique of inhibiting heat fog, it has been said that mercury compounds are effective, as described in, for example, U.S. Pat. No. 3,589,903. However, as is well known, mercury compounds are toxic, and the use of sensitive materials containing such a toxic material is not preferred for health and safety reasons. Even though the toxicity is low itself, indirectly a serious problem occurs in the production of regenerated paper if paper is used as a support for such an element.

No technique of improving the whiteness (or removing residual color) has been known hitherto.

SUMMARY OF THE INVENTION

Accordingly, an object of the present invention is to provide heat-developable photosensitive materials which have a low heat fogging property.

Another object of the present invention is to provide heat-developable photosensitive materials having high whiteness.

A further object of the present invention is to provide heat-developable photosensitive materials having low residual color.

As the result of much research in order to achieve the above objects, the present invention has been accomplished. Namely, the present invention provides a heat-developable photosensitive material which comprises a support having thereon one or more layers containing at least (a) an organic silver salt, (b) a catalytic amount of a photosensitive silver halide or a component capable of forming a photosensitive silver halide, (c) a reducing agent and (d) at least one of an inorganic peroxide and a peroxodisulfate.

DETAILED DESCRIPTION OF THE INVENTION

The inorganic peroxides used in the present invention, use of which is one characteristic of the present invention, are compounds having a negatively charged divalent $O_2$ group $(-O-O-)^{-2}$ represented by the formula $M^I{}_2O_2$, wherein $M^I$ is H, Li, Na, K, Rb, Cs or $NH_4$ and by the formula $M^{II}O_2$ $M^{II}$ is Mg, Ca, Sr, Ba, Zn, Cd or Hg. Of these compounds, hydrogen peroxide ($H_2O_2$), i.e., wherein $M^I$ is H, is most effective.

The amount of the inorganic peroxide employed is about 0.001 to 50 mols per mol of the organic silver salt of Component (a). Preferably, the amount is 0.01 to 10 mols.

The peroxodisulfates used in the present invention, use of which is another characteristic of the present invention, are represented by the formula $M_2{}'^{I}S_2O_8$, wherein $M^I$ is H, Li, Na, K, Rb or $NH_4$. Other peroxodisulfates are barium peroxodisulfate and lead peroxodisulfate. Of these compounds, those compounds wherein $M'^I$ is H, $NH_4$, Na and K are particularly effective.

The amount of the peroxodisulfate employed is about $10^{-6}$ to $10^{-2}$ mols per mol of the organic silver salt of Component (a). Preferably, the amount is $10^{-5}$ to $10^{-4}$ mols.

If the amount of inorganic peroxide or peroxodisulfate is lower than about 0.001 mol per mol of the organic silver salt or about $10^{-6}$ of the organic silver salt, respectively, the desired effect of inhibiting heat fog to not exhibited. On the other hand, if the amount of the inorganic peroxide or peroxodisulfate is greater than about 50 mols per mole of the organic silver salt or greater than about $10^{-2}$ mol per mol of the organic silver salt, respectively, undesirable effects occur, for example, the color tone of the images changes from a black color to an undesirable brown color or the sensitivity decreases.

The organic silver salts of Component (a) used in the present invention are substantially colorless silver salts which are stable to light and form silver images by reacting with the reducing agent (c) when heated halogen-substituted a temperature above 80° C up to about 180° C, and preferably above 100° C up to about 150°

C, in the presence of the exposed light-sensitive silver halide (b). Examples of such silver salts of component (a), are silver salts of organic compounds containing an imino group, a mercapto group, a hydroxyl group or a carboxyl group.

Suitable specific examples of these compounds are given in the following.

1. Silver salts of compounds having an imino group; silver salt of benzotriazole, silver salt of nitrobenzotriazole, silver salt of an alkyl-substituted benzotriazole (e.g., silver salt of methylbenzotriazole, etc.), silver salt of a halogen-substituted benzotriazole (e.g., silver salt of bromobenzotriazole, silver salt of chlorobenzotriazole, etc.), silver salt of a carboimido-substituted benzotriazole (e.g.,

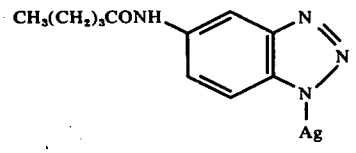

or

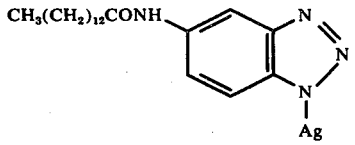

etc.), silver salt of a substituted benzimidazole (e.g., silver salt of 5-chloro-benzimidazole, silver salt of 5-nitrobenzimidazole, etc.), silver salt of carbazole, silver salt of saccharin, silver salt of phthalazinone, silver salt of a substituted phthalazinone, silver salt of a phthalimide, silver salt of pyrrolidone, silver salt of tetrazole, silver salt of imidazole, and the like, 2. Silver salts of compounds having a mercapto group or a thion group; silver salt of 3-mercapto-4-phenyl-1,2,4-triazole, silver salt of 2-mercapto-benzimidazole, silver salt of 2-mercapto-5-amino-thiadiazole, silver salt of 1-phenyl-5-mercaptotetrazole, silver salt of 2-mercaptobenzothiazole, silver salt of 2-(S-ethylthioglycolamido)benzothiazole, silver thioglycolates as described in Japanese Patent Application Laid-open No. 2822/73 (e.g., silver S-alkyl ($C_{12}$ – $C_{22}$)-thioglycolate, etc.), silver dithiocarboxylates (e.g., silver dithioacetate, etc.), silver salt of thioamide, silver salt of thiopyridine (e.g., silver salt of 5-carbethoxy-1-methyl-2-phenyl-4-thiopyridine, etc.), silver salt of dithiodihydroxybenzole, silver salt of mercaptotriazine, silver salt of 2-mercaptobenzoxazole, silver salt of mercaptooxadiazole, and the like, 3. Silver salts of compounds having a carboxy group;

i. silver salts of aliphatic carboxylic acids; silver caprate, silver laurate, silver myristate, silver palmitate, silver stearate, silver behenate, silver maleate, silver fumarate, silver tartrate, silver furoate, silver linoleate, silver oleate, silver hydroxystearate, silver adipate, silver sebacate, silver succinate, silver acetate, silver butyrate, silver camphorate, and the like, ii. silver salts of aromatic carboxylic acid an others; silver benzoate, substituted silver benzoate (e.g., silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.), silver gallate, silver tannate, silver phthalate, silver terephthalate, silver salicylate, silver phenylacetate, silver pyromellitate, silver salt of 4'-n-octadecyloxydiphenyl-4-carboxylic acid, silver salt of a thioncarboxylic acid as described in U.S. Pat. No. 3,785,830, silver salt of an aliphatic carboxylic acid having a thioether group as described in U.S. Pat. No. 3,330,663, and the like.

4. Other silver salts; silver salt of 4-hydroxy-6-methyl-1,3,3a,7-tetrazaindene, silver salt of 5-methyl-7-hydroxy-1,2,3,4,6-pentazaindone, silver salt of tetrazaindene as described in British Pat. No. 1,230,642, silver salt of S-2-aminophenylthiosulfuric acid as described in U.S. Pat. No. 3,549,379, silver salt of a metal-containing aminoalcohol as described in Japanese Patent Application Laid-open No. 6586/71, silver salt of an organic acid metal chelate as described in Belgian Pat. No. 768,411, and the like.

In necessary, titanium oxide, zinc oxide, carboxylic acids of metals other than silver (e.g., gold laurate, gold stearate, gold behenate, etc.) or a like oxidizing agent can be used in combination with the above described organic silver salts. These silver salts are comparatively stable to light and the silver salts located at the exposed areas are reduced, upon heating, with a reducing agent with the aid of the catalytic action of exposed silver halide to form a silver image.

It has been said in the art that silver salts of higher fatty acids such as silver behenate or silver stearate, silver benzotriazole and silver saccharin are preferred as image forming compounds. However, in the case of producing the silver salts of higher fatty acids such as silver behenate or silver stearate, a large amount of a solvent and large scale equipment are necessary in order to produce these silver salts in a large amount at one time causing a remarkable increase in the cost, because raw materials such as behenic acid, salts of behenic acid, stearic acid and salts of stearic acid have low solubility in solvents such as water or methanol, etc. Further, in the case of silver benzotriazole and silver saccharin, an increase in the cost is inevitable, because benzotriazole and saccharin as raw materials have a higher cost than fatty acids. In addition, excellent photographic properties can not be obtained. Thus, it is preferred to use silver salts of fatty acids other than stearic and behenic acids.

Fatty acid silver salts of fatty acids having a number of carbon atoms which is too low such as silver acetate are photosensitive per se and gradually darken on exposure to light. Therefore, they are not suitable where the sensitive materials are stored on exposure to light for a long period of time. However, they can be used in the same manner as other organic silver salts if they are used with appropriate precautions, e.g., as to storage, being taken, and thus they are included in the scope of the present invention. Fatty acid silver salts, for example, silver salts of fatty acids having a medium number of carbon atoms, such as silver caprate and silver laurate are preferred organic silver salts, because they do not have the above described defects for those silver salts of fatty acids having a number of carbon atoms which is too low or too high.

Preparation of such organic silver salts is generally carried out by processes which comprise mixing a solution of a silver salt forming organic compound dissolved in a suitable solvent with an aqueous solution of a silver salt such as silver nitrate or a silver complex salt. For example, a method of producing silver benzotriazole which comprises reacting benzotriazole with silver nitrate by mixing a methanol solution of benzotriazole with an aqueous solution of silver nitrate, and a method as described in Canadian Pat. No. 847,351 which comprises reacting silver nitrate with benzotriazole by mixing a solution of silver nitrate in a solvent A which dissolves silver nitrate and nitric acid but dissolves silver benzotriazole only slightly, such as water, dimethylformamide or dimethyl sulfoxide, with a solution of benzotriazole in a solvent B which dissolves benzotriazole but does not dissolve silver benzotriazole and silver nitrate or dissolves them only slightly wherein the solubility of the solvent A is about 1 to 30% by weight of the total liquid (solvent A + solvent B), for example, alcohol esters and phenol esters of phosphoric acid, phthalic acid or a carboxylic fatty acid and glycerin esters of a higher fatty acid such as tricresyl phosphate, dimethoxyethyl phthalate, di-n-butyl phthalate, diethyl sebacate, monooctyldibutyl phosphate, tributyl phosphate, castor oil and linseed oil, etc. A similar method can be applied too in many cases for producing other organic silver salts.

Processes of preparing organic silver salts which are suitable for producing silver salts of organic carboxylic acids such as silver laurate, silver caprate, silver myristate, silver palmitate, silver stearate, silver behenate, silver adipate of silver sebacate include a method which comprises mixing an aqueous solution of a water soluble carboxylic acid salt (for example, the sodium salt, the potassium salt, the lithium salt and the ammonium salt, etc.) with an aqueous solution of silver nitrate to produce a silver salt, a method which comprises mixing a solution of an organic carboxylic acid in a solvent which dissolves the organic carboxylic acid but dissolves the organic carboxylic acid salts and silver nitrate only slightly and is substantially immiscible with water (e.g., phosphoric acid esters such as tricresyl phosphate, tributyl phosphate or monooctyldibutyl phosphate, phthalic acid esters such as diethyl dibutyl phthalate, dimethyl phthalate, dioctyl phthalate or dimethoxyethyl phthalate, carboxylic acid esters such as amyl acetate, isopropyl acetate, isoamyl acetate, ethyl acetate, 2-ethylbutyl acetate, propyl acetate, dioctyl sebacate, dibutyl sebacate, diethyl sebacate, diethyl succinate, ethyl formate, propyl formate, butyl formate, amyl formate, ethyl valerate, diethyl tartarate, methyl butyrate, ethyl butyrate or isoamyl butyrate, glycerin esters of higher fatty acids such as castor oil, aromatic hydrocarbons such as benzene, toluene or xylene, n-hexane or cyclohexane, etc.) and, if desired, an emulsion in water or an alkaline aqueous solution (such as an aqueous solution of sodium hydroxide, an aqueous solution of potassium hydroxide or an aqueous ammonia solution, etc.) with an aqueous solution of silver nitrate or an aqueous solution of a silver complex salt (preferably, an alkali soluble silver complex salt having a dissolution constant higher than the silver salts of organic carboxylic acids such as silver amine complex salt, silver methylamine complex salt and silver ethylamine complex salt, etc.) to produce an organic carboxylic acid silver salt, and a method which cpomprises mixing an emulsion composed of an aqueous solution of an organic carboxylic acid silver salt (such as the sodium salt, the potassium salt or the ammonium salt, etc.) and a water-substantially immiscible solvent with an aqueous solution of a silver salt such as silver nitrate or a silver complex salt to produce an organic carboxylic acid silver salt. These methods can be applied to preparation of other organic silver salts.

The photosensitive silver halide of component (b) used in the present invention, which is present in a catalytic amount, is preferably formed simultaneously with the preparation of the organic silver salt (a) by producing the organic silver salt (a) in the presence of a compound which forms the photosensitive silver halide (b). More specifically, for example, a compound which forms the photosensitive silver halide is incorporated in a solution of the above described organic carboxylic acid or salt thereof so as to be present (as a solution when it is soluble or as an emulsion or dispersion when it is not soluble), or a compound which forms the photosensitive silver halide is formed during preparation of the organic silver salt by carrying out a method which comprises mixing a solution, dispersion or emulsion of the compound which forms a photosensitive silver halide with a solution of an organic carboxylic acid or salt thereof and a solution of silver nitrate or a silver complex salt, by which the compound is present with the organic silver salt. This method has been described in Japanese Patent Application No. 65727/1973.

Another more preferred method of forming the catalytic amount of photosensitive silver halide is that described in U.S. Pat. No. 3,457,075, wherein the compound which forms a photosensitive silver halide is reacted with a previously produced organic silver salt to convert a part of the organic silver salt into a catalytic amount of silver halide. This method is utilized in most of the above described patents.

An additional method of forming the catalytic amount of photosensitive silver halide is that described in U.S. Pat. No. 3,152,904, wherein silver halide is previously prepared and the silver halide is mixed with an organic silver salt. Examples of silver halides are silver chloride, silver bromide, silver bromochloride, silver iodobromochloride, silver iodobromide and silver iodide.

These photosensitive silver halides can be those comprising coarse particles or fine particles. However, silver halides comprising a very fine particles are particularly preferred.

The photosensitive silver halide can be produced by various methods known in the photographic field. For example, the silver halide can be produced using a single jet method, a twin jet method, for example, a Lipmann emulsion, an ammonia method, and silver halides ripened with thiocyanates or thioethers; for example, those described in U.S. Pat. Nos. 2,222,264, 3,320,069 and 3,271,157.

Suitable compounds which can be used to form the photosensitive silver halide include the following compounds.

Namely, inorganic compounds represented by the formula $$MX_n$$

wherein $M$ represents a hydrogen atom, an ammonium group or a metal (e.g., strontium, cadmium, zinc, tin, chromium, sodium, barium, iron, cesium, lanthanum, copper, calcium, nickel, magnesium, potassium, aluminum, antimony, gold, cobalt, mercury, lead, berylium, lithium, manganese, gallium, indium, rhodium, ruthenium, palladium, iridium, platinum, thallium or bismuth, etc.), X represents a halogen atom (chlorine, bromine or iodine) and n is 1 when M is a hydrogen atom or an ammonium group, or n is the valency of the metal when M is a metal atom, can be used.

Further, organic halogen compounds such as triphenyl-methyl chloride, triphenylmethyl bromide, 2-bromo-2-methyl-propane, 2-bromobutyric acid, 2-bromoethanol, dichlorobenzophenone, iodoform, bromoform, carbon tetrabromide, N-halo-succinimides, N-haloacetamides, 1,3-dibromo-5,5-dimethylthiohydantoin or 1,3-dichloro-5,5-dimethylthiohydantoin are also effective as compounds which form a photosensitive silver halide.

In addition, onium halides such as cetylethyldimethylammonium bromide or trimethylbenzyl ammonium bromide, etc. are also effective as compounds which form a photosensitive silver halide.

The above described compounds which form a photosensitive silver halide can be used alone or as a combination of two or more thereof. A suitable amount of these compounds is about 0.001 to 0.5 mols, and preferably 0.01 to 0.2 mols per mol, of the organic silver salt of Component (a). If the amount is less than about 0.001 mol per mole of the organic silver salt, the sensitivity is reduced. If the amount is more than about 0.5 mol per mol of the organic silver salt, discoloration by light occurs and the contrast between the image area and the background area decreases. Here, discoloration by light means that the nonimage area (background area) gradually discolors when the material developed by heating is allowed to stand under normal room illumination.

Suitable examples of reducing agents of Component (c) which can be used in the present invention include organic reducing agents which have a reduction ability suitable for reducing the silver salt (a) to form a silver image as a result of the catalytic activity of the silver halide in the exposed area when heated. Although these reducing agents are determined by the particular silver salt Compound (a) as an oxidizing agent used, they can be selected from the following compounds.

1. Monohydroxybenzenes
2. Dihydroxybiphenyls
3. Di- or polyhydroxybenzenes
4. Naphthols, naphthylamines and aminonaphthols
5. Hydroxybinaphthyls
6. Aminophenols
7. p-Phenylenediamines
8. Alkylene-bisphenols
9. Ascorbic acid and derivatives thereof
10. Pyrazolidones.

Examples of these compounds are as follows.

1. Monohydroxybenzenes:

p-Phenylphenol, o-phenylphenol, p-ethylphenol, p-t-butylphenol, p-sec-butylphenol, p-t-amylphenol, p-methoxyphenol, p-ethoxyphenol, p-cresol, 2,6-di-t-butyl-p-cresol, 2,4-xylenol, 2,6-xylenol, 3,4-xylenol, p-acetylphenol, 1,4-dimethoxyphenol, 2,6-dimethoxyphenol, hydroquinone mono-n-hexyl ether, hydroquinone monobenzyl ether and chlorothymol, etc.

2. Dihydroxybiphenyls: 3,3′,5,5′-Tetra-t-butyl-4,4′-dihydroxybenzene, etc.

3. Di- or polyhydroxybenzenes: Hydroquinone, methylhydroquinone, t-butylhydroquinone, 2,5-dimethylhydroquinone, 2,6-dimethylhydroquinone, t-octylhydroquinone, phenylhydroquinone, methoxyhydroquinone, ethoxyhydroquinone, chlorohydroquinone, bromohydroquinone, hydroquinone monosulfonic acid salt, catechol, 3-cyclohexylcatechol, resorcinol, gallic acid, methyl gallate, and n-propyl gallate, etc.

4. Naphthols, naphthylamines and aminonaphtols:

α-Naphthol, β-naphthol, 1-hydroxy-4-methoxynaphthalene, 1-hydroxy-4-ethoxynaphthalene, 1,4-dihydroxynaphthalene, 1,5-dihydroxynaphthalene, 1-hydroxy-2-phenyl-4-methoxynaphthalene, 9-hydroxy-2-methyl-4-methoxynaphthalene, potassium 1-amino-2-naphthol-6-sulfonate, 1-hydroxy-4-aminonaphthalene and 1-naphthylamino-7-sulfonic acid, etc.

5. Hydroxybinaphthyls:

1,1′-Dihydroxy-2,2′-binaphthyl, 4,4′-dimethoxy-1,1′-dihydroxy-2,2′-binaphthyl, 6,6′-dibromo-2,2′-dihydroxy-1,1′-binaphthyl, 6,6′-dinitro-2,2′-dihydroxy-1,1′-binaphthyl and bis-(2-hydroxy-1-naphthyl)methane, etc.

6. Aminophenols:

p-Aminophenol, o-aminophenol, 2,4-diaminophenol, N-methyl-p-aminophenol, 2-methoxy-4-aminophenol, and 2-β-hydroxyethyl-4-aminophenol, etc.

7. p-Phenylenediamines:

N,N′-Diethyl-p-phenylenediamine and N,N′-Dibenzylidene-p-phenylenediamine, etc.

8. Alkylene bisphenols:

1,1-Bis-(2-hydroxy-3-t-butyl-5-methylphenyl)methane, 1,1-bis-(2-hydroxy-3,5-dimethylphenyl)-3,5,5-trimethylhexane, 1,1-bis-(2-hydroxy-3,5-di-t-butylphenyl)-2-methylpropane, 2,2-bis-(4-hydroxy-3-methylphenyl)propane, 4,4-bis-(4-hydroxy-3-methylphenyl)heptane, 2,2-bis-(4-hydroxy-3-isopropylphenyl)propane, 2,2-bis-(4-hydroxy-3-phenylphenyl)-propane, 1,1-bis-(4-hydroxy-3-methylphenyl)cyclohexane, 2,2-bis-(4-hydroxy-3,5-dimethylphenyl)-propane, 2,2-bis-(4-hydroxy-3-t-butyl-5-methylphenyl)propane, 3,3-bis-(4-hydroxy-3-t-dodecylphenyl)hexane, (4,4′-dihydroxy-3-methyldiphenyl)-2,2-propane, (4,4′-dihydroxy-3-t-octyldiphenyl)-2,2-propane, (4,4′-dihydroxy-3-t-butyldiphenyl)-4-methyl-2,2-pentane, (4,4′-dihydroxy-3-methyl-3′-t-butyldiphenyl)-2,2-propane, (4,4′-dihydroxy-3-methyl-5-t-butyldiphenyl)-2,2-propane, 2,2-bis-(4-hydroxyphenyl)propane, (4,4′-dihydroxy-3,3′,5-trimethyldiphenyl)-3,3-pentane, N-(4-hydroxyphenyl)salicylamide, 2,2-bis-(3,5-dibromo-4-hydroxyphenyl)propane and bis-(3-methyl-4-hydroxy-5-t-butylphenyl)sulfide, etc.

9. Ascorbic acid and derivatives thereof: *l*-Ascorbic acid, esters such as ethyl *l*-ascorbate, and diesters such as diethyl *l*-ascorbate, etc.

10. Pyrazolidones: 1-Phenyl-3-pyrazolidone and 4-methyl-4-hydroxymethyl-1-phenyl-3-pyrazolidone, etc.

These reducing agents can be used individually or as a combination of two or more thereof. Selection of the preferred reducing agents depends to a great extent upon reduction ability with respect to the silver salt oxidizing agent (a) to be reduced employed. For example, ascorbic acid which has strong reducing ability is suitable for silver salts which are very difficult to reduce such as silver benzotriazole. Further, for silver salts of higher fatty acids, it is necessary to select a stronger reducing agent as the number of carbon atoms of the fatty acid increases. A relatively weak reducing agent such as p-phenylphenol is suitable for silver laurate, while a combination of such a relatively weak reducing agent with a relatively strong reducing agent such as 1,1′-bis-(2-hydroxy-3-t-butyl-5-methylphenyl)methane is preferred for silver benzoate.

The amount of the above described reducing agents can not be set forth unequivocally, because it is generally dependent upon the combination of Component (a) and Component (c). However, a range of about 0.1 to 5 mols of the reducing agent per mol of the silver salt oxidizing agent (a) is effective.

In the present invention, Components (a), (b), (c) and (d) are dispersed in a binder (e) and applied to a support. In such case, all of the components (a), (b), (c) and (d) can be dispersed in a binder and applied to a support as one layer or Components (a) and (b) and Components (c) and (d), Components (a), (b) and (d) and Component (c) or Components (a), (b) and (c) and Component (d) each can be dispersed in a binder respectively and applied separately to the support so as to form a multilayer structure. As binders, any materials used in this field can be used. In general, hydrophobic binders are preferred. However, hydrophilic binders can be used. Preferred binders are those which are transparent or semi-transparent. For example, natural materials such as gelatin, gelatin derivatives, a mixture thereof with a latex, vinyl polymers, cellulose derivatives and synthetic polymers, etc., can be used as a binder.

Specific examples of binders include gelatin, phthalated gelatin, polyvinyl butyral, polyacrylamide, cellulose acetate butyrate, cellulose acetate propionate, polymethylmethacrylate, polyvinylpyrrolidone, polystyrene, ethyl cellulose, polyvinyl chloride, rubber chloride, polyisobutylene, butyadiene-styrene copolymers, vinyl chloride-vinyl acetate copolymers, vinyl acetate-vinyl chloride-maleic acid terpolymers, polyvinyl alcohol, polyvinyl acetate, benzyl cellulose, cellulose diacetate, cellulose triacetate, cellulose propionate and cellulose acetate phthalate. These binders can be used individually or, if desired, as a mixture of two or more thereof.

A preferred ratio by weight of the binder to the organic silver salt of Component (a) ranges from about 10:1 to 1:10 and preferably 4:1 to 1:4.

Further, it is possible to omit the use of the binder where Component (a) or (c) is a high molecular weight material having a function of a binder.

A preferred amount of silver applied to the support ranges from about 0.2 to 3 g and preferably 0.4 to 2 g per $m^2$ of the support. If the amount is less than about 0.2 g of silver per $m^2$, sufficient image density can not be obtained. If the amount is higher then about 3 g of silver per $m^2$, the photographic properties are not additionally improved while the cost increases.

If desired, the heat-developable photosensitive materials can contain a matting agent, for example, silica, starch or kaolin, etc. Further the photosensitive material can contain a fluorescent whitening agent such as a stilbene, a triazine, an oxazole or a coumarin fluorescent whitening agent.

The heat-developable photosensitive layers of the present invention can be coated using various methods. Examples of suitable methods, include a dip coating method, an air-knife coating method, a curtain coating method and an extrusion coating method using a hopper as described in U.S. Pat. No. 2,681,294. If desired, two or more layers can be applied at the same time.

Some spectral sensitizing dyes which have been hitherto useful for sensitizing silver halide emulsions can be advantageously used in order to further enhance the sensitivity of the heat-developable photosensitive materials of the present invention.

For example, they can be spectrally sensitized by adding a sensitizing dye as a solution or dispersion in an organic solvent. Examples of spectral sensitizer which can be used are acid dyes such as cyanine dyes, merocyanine dyes, rhodacyanine dyes, styryl dyes, erythrosine, eosine and fluorescein, etc. Particularly, dyes containing carboxyl groups are preferred. These dyes are used in the amount of about $10^{-6}$ to about $10^{-2}$ per mol of the organic silver salt of Component (a).

Examples of the sensitizing dyes are as follows.

Preferred rhodacyanine dyes are represented by the following formula (I)

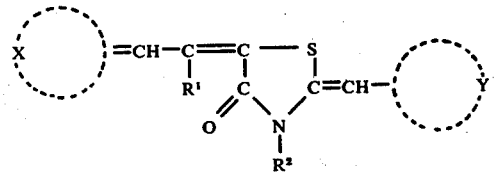

(I)

wherein $R^1$ and $R^2$ each represents a hydrogen atom, an alkyl group or a phenyl group, and X and Y each represents a group of atoms necessary to complete a heterocyclic nucleus selected from thiazoline, thiazole, benzoxazole, benzothiazole, benzoselenazole, tetrazole, naphthothiazole, dimethylindolenine, quinoline and pyridine nuclei. These heterocyclic nuclei can be substituted with alkyl groups, or aryl groups or a condensed ring can be a part thereof. Dyes of the formula (I) are disclosed in German Pat. No. (OLS) 2,328,868.

Specific examples of these dyes of the formula (I) are as follows.

Compound I-1

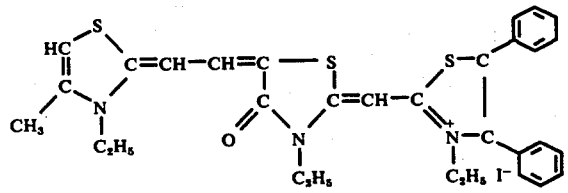

Compound I-2

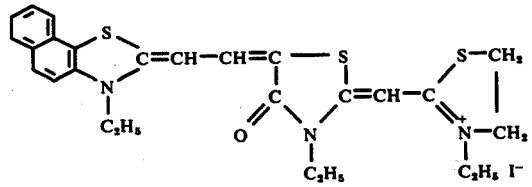

Compound I-3

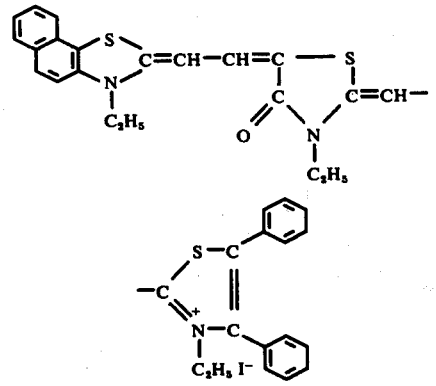

Compound I-4

-continued
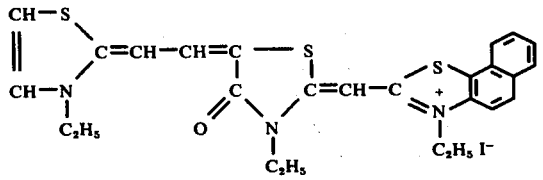
Compound I-5
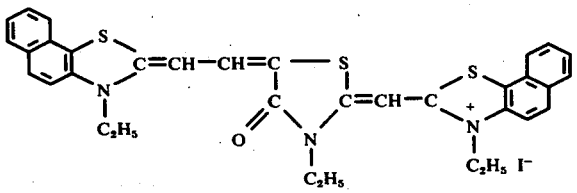
Compound I-6
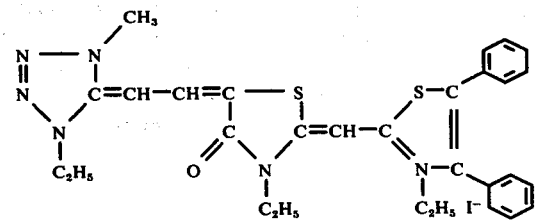
Compound I-7
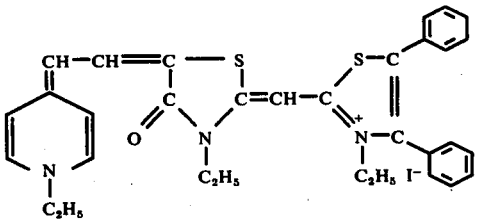
Compound I-8
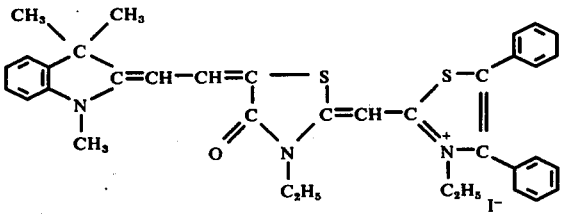
Compound I-9
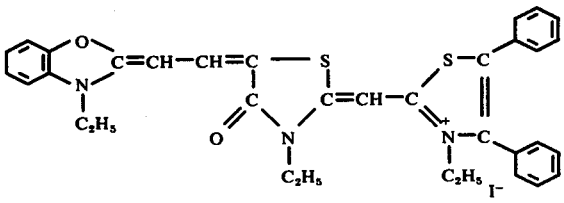
Compound I-10
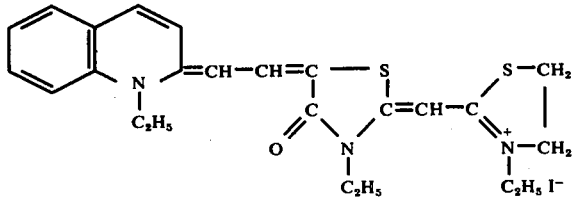
Compound I-11
-continued
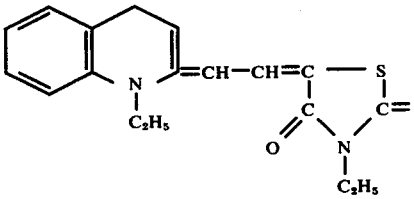
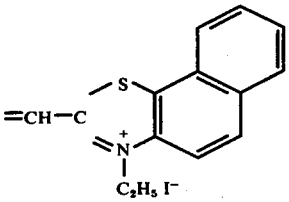
Compound I-12
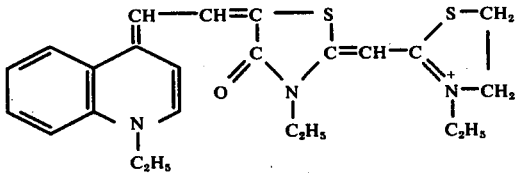
Compound I-13
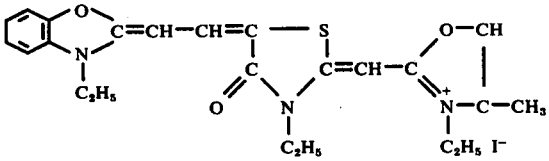
Compound I-14
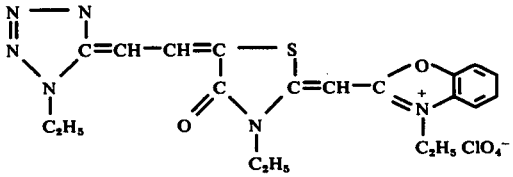
Compound I-15
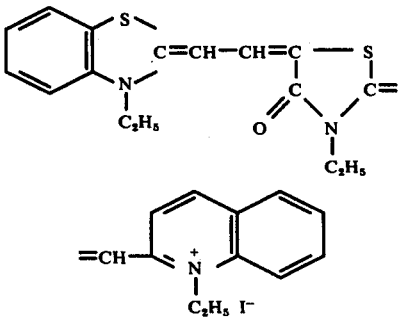
Compound I-16
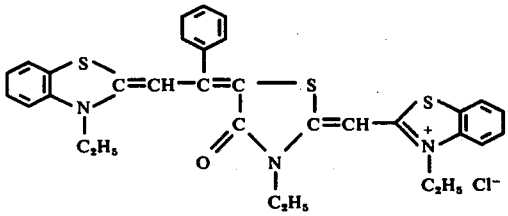

-continued

Compound I-17

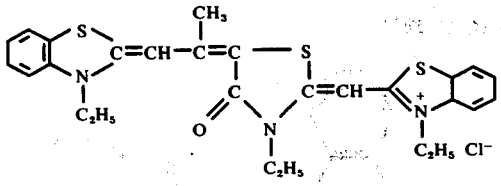

Suitable examples of styryl dyes are compounds represented by the following formula (II), quinoline N-oxides of the compounds and quinolinium salts of the compounds.

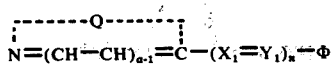

(II)

In the formula (II), $\phi$ is a monovalent group represented by

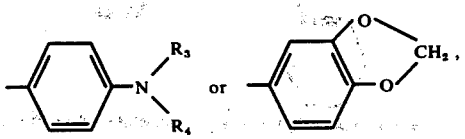

a lower alkyl group or a benzyl group, $X_1$ and $Y_1$ each represents a trivalent group represented by = CH - or =N-, a and n are each an integer of 1 or 2, and Q represents the group of atoms necessary to form a quinoline ring.

Where $R_3$ and $R_4$ in the above formula (II) are lower alkyl groups, those alkyl groups having 1 to 3 carbon atoms, such as a methyl group, an ethyl group and a n-propyl group are preferred. $R_1$ and $R_2$ can be the same or can be different. Further, the quinoline ring can contain substituents. Examples of such substituents are lower alkyl groups, substituted lower alkyl groups, phenyl groups, lower alkoxy groups, halogen atoms, lower dialkylamino groups, lower alkoxycarbonyl groups and $-(X_1 = Y_1)_n-\phi$ defined in the formula (II). Dyes of the formula (II) are disclosed in German Pat. No. (OLS) 2,363,586.

Specific examples of the dyes of the formula (II) are as follows.

Compound II-1

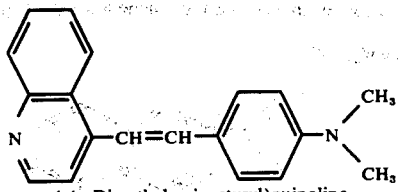

4-(p-Dimethylaminostyryl)quinoline

Compound II-2

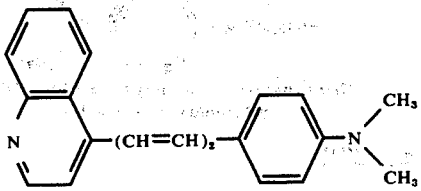

-continued 4-(4-p-Dimethylaminophenyl-1,3-butadienyl)quinoline

Compound II-3

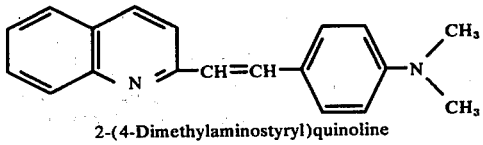

2-(4-Dimethylaminostyryl)quinoline

Compound II-4

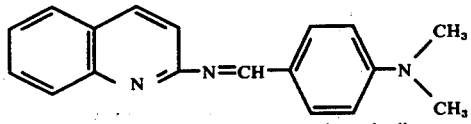

2-(Dimethylaminobenzylidene)aminoquinoline

Compound II-5

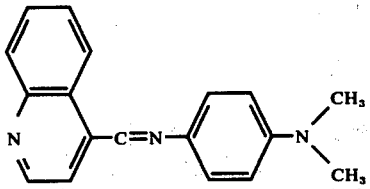

4-(p-Dimethylaminophenylimino)cyanomethylquinoline

Compound II-6

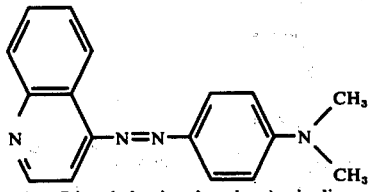

4-(p-Dimethylaminophenylazo)quinoline

Compound II-7

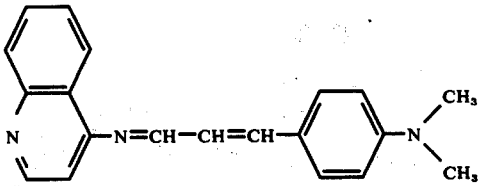

4-((3-p-Dimethylaminophenyl)-2-propenylidene)aminoquinoline

Compound II-8

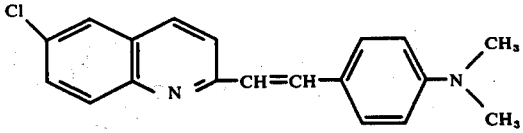

6-Chloro-2-(p-dimethylaminostyryl)quinoline

Compound II-9

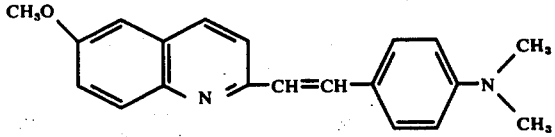

6-Methoxy-2-(p-dimethylaminostyryl)quinoline

Compound II-10

-continued

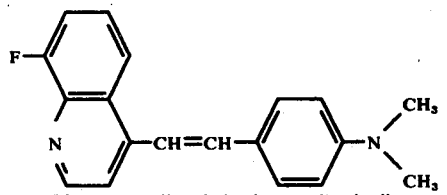

8-Fluoro-4-(p-dimethylaminostyryl)quinoline

Compound II-11

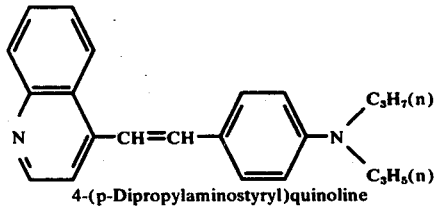

4-(p-Dipropylaminostyryl)quinoline

Compound II-12

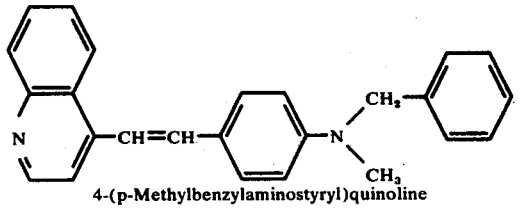

4-(p-Methylbenzylaminostyryl)quinoline

Compound II-13

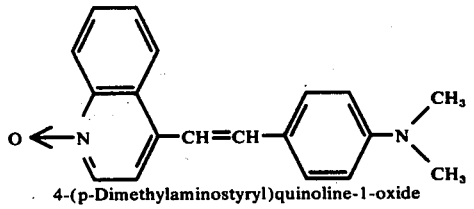

4-(p-Dimethylaminostyryl)quinoline-1-oxide

Compound II-14

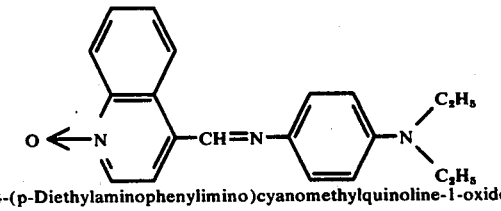

4-(p-Diethylaminophenylimino)cyanomethylquinoline-1-oxide

Compound II-15

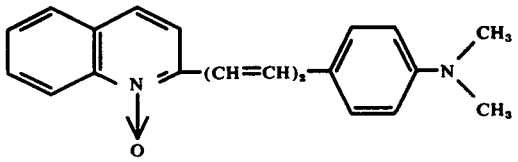

Compound II-16

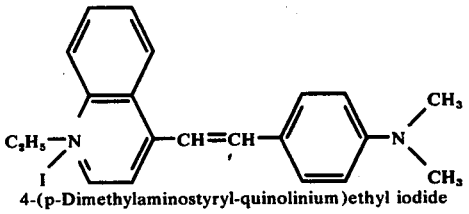

4-(p-Dimethylaminostyryl-quinolinium)ethyl iodide

Compound II-17

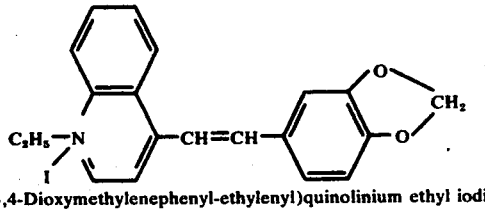

4-(3,4-Dioxymethylenephenyl-ethylenyl)quinolinium ethyl iodide

Compound II-18

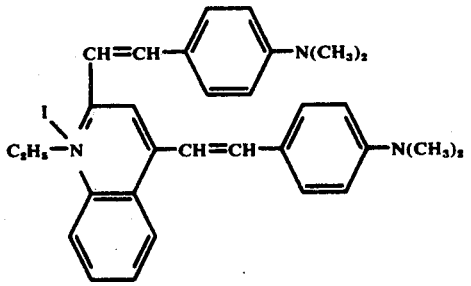

2,4-Bis-(p-dimethylaminostyryl)quinolinium·ethyl iodide

Compound II-19

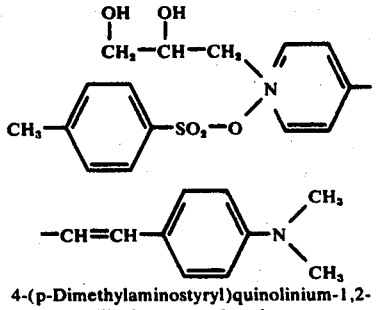

4-(p-Dimethylaminostyryl)quinolinium-1,2-dihydroxypropyltosylate

Compound II-20

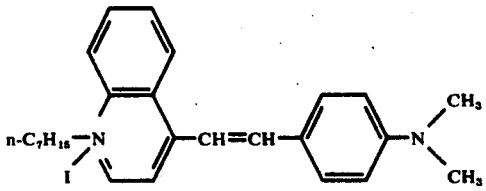

4-(p-Dimethylaminostyryl)quinolinium-n-heptyl iodide

Compound II-21

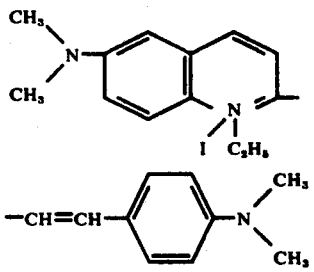

2-(p-Dimethylaminostyryl)-6-dimethylamino-quinolinium ethyl iodide

Compound II-22

-continued

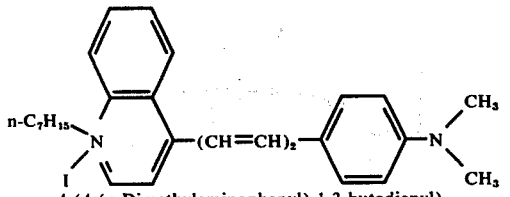

4-(4-(p-Dimethylaminophenyl)-1,3-butadienyl)-quinolinium-n-heptyl iodide

Compound II-23

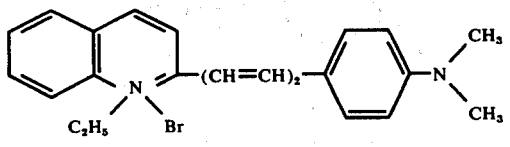

2-(4-Dimethylaminophenyl)-1,3-butadienyl)-quinolinium ethyl bromide

Examples of merocyanine dyes include those having the nuclei represented by (IIIa), (IIIb) and (IIIc)

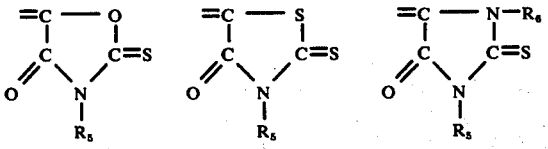

(IIIa) (IIIb) (IIIc)

wherein $R_5$ and $R_6$ each represents a hydrogen atom, an alkyl group, an aryl group, an aralkyl group, a hydroxyalkyl group, a carboxyl group or a carboxyalkyl group. Dyes of the formula (III) are disclosed in U.S. Pat. No. 3,761,279.

Examples of the compounds including nuclei of the general formulas (III*a*), (III*b*) and (III*c*) are as follows.

Compound III-1

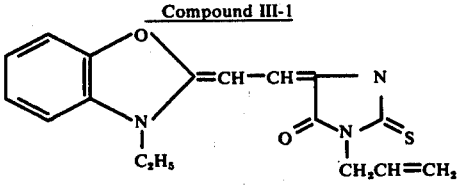

Compound III-2

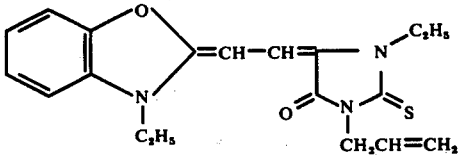

Compound III-3

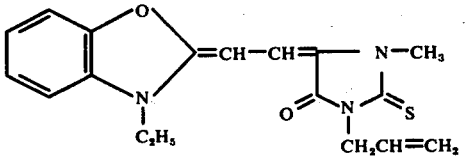

Compound III-4

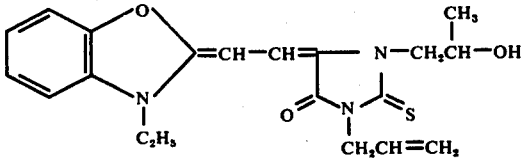

-continued

Compound III-5

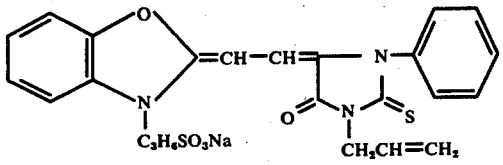

Compound III-6

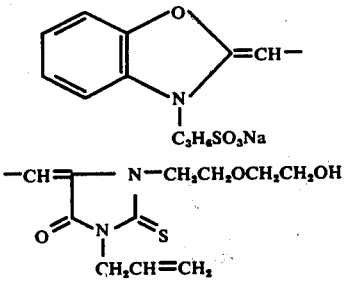

Compound III-7

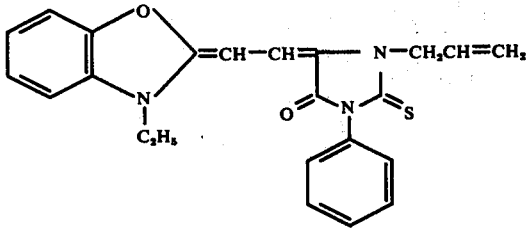

Compound III-8

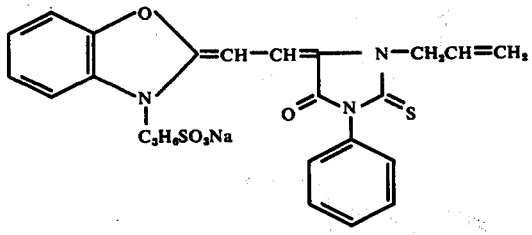

Compound III-9

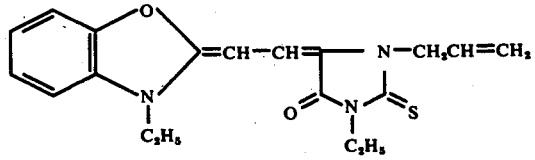

Compound III-10

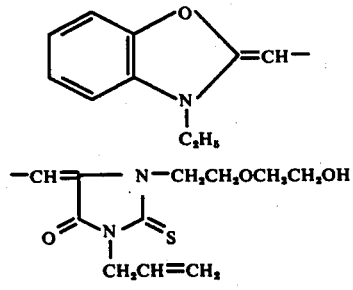

Compound III-11

-continued

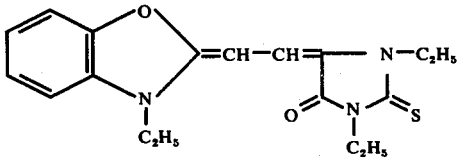

Compound III-12

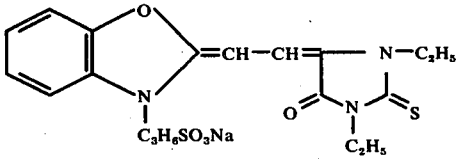

Compound III-13

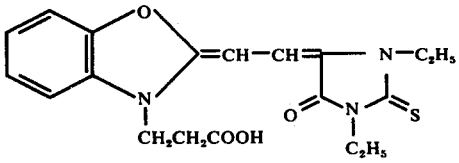

Compound III-14

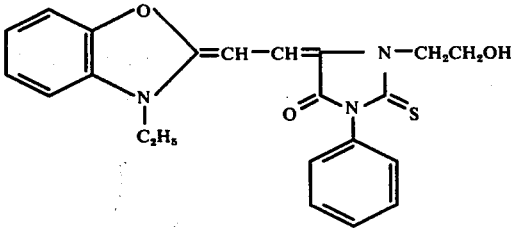

Compound III-15

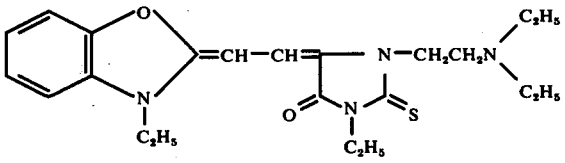

Compound III-16

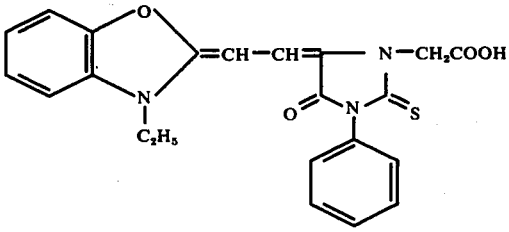

Compound III-17

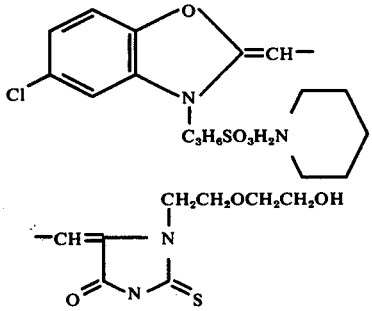

Compound III-18

-continued

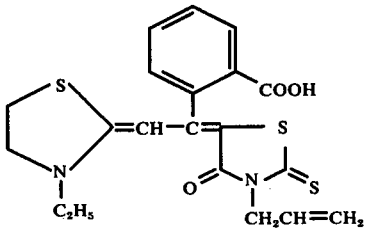

Compound III-19

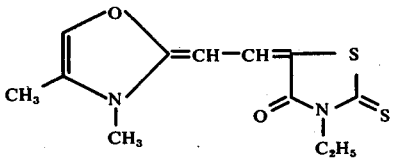

Compound III-20

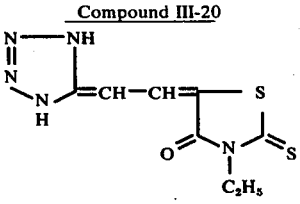

Suitable acid dyes are those described in, for example, Japanese Patent Application Nos. 7624/1973, 12587/1973 and 50903/1973 and German Pat. No. (OLS) 2,404,591.

Some examples of acid dyes include acid dyes represented by the following formulae (IV), (V), (VI) and (VII).

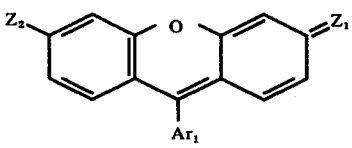

(IV)

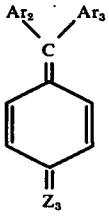

(V)

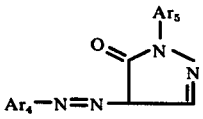

(VI)

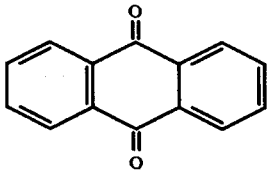

(VII)

In the formulas (IV) to (VII), $Z_1$ and $Z_3$ each represent = O or

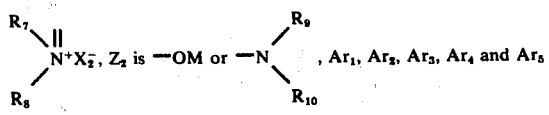

each represents an unsubstituted or substituted aryl group, $X_2^-$ is an anion, and $R_7$, $R_8$, $R_9$ and $R_{10}$ each represents an unsubstituted or substituted alkyl or aryl group. Where $Z_1$ is =O, $Z_2$ is —OM and $Ar_1$ does not have a halogen substituent, the nucleus in the formula (IV) has two halogen substituents. Further, $Ar_1$ has at least one of $—SO_3M$ or —COOM as a substituent, and at least one or $Ar_4$ and $Ar_5$ has at least one of $—SO_3M$ or —COOM as a substituent. Compounds represented by the formula (VII) have at least one of $—SO_3M$ or —COOM in the nucleus or in substituents on the nucleus. M represents a hydrogen atom, an alkali metal atom, an alkaline earth metal atom or $NH_4$. Each nucleus of the formulae (IV) to (VII) can have other substituents thereon other than the above described substituents. Furthermore,

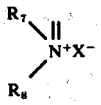

can be in the form of an inner salt.

Specific examples of acid dyes of the general formulas (IV) to (VII) are as follows.

Compound IV-1

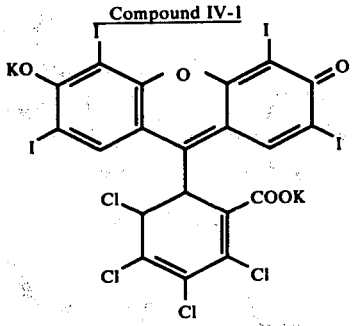

Compound IV-2

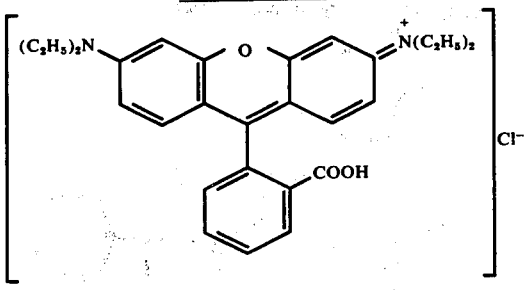

Compound IV-3

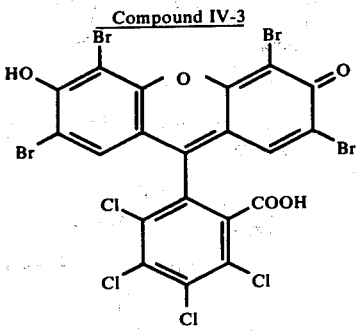

-continued

Compound IV-4

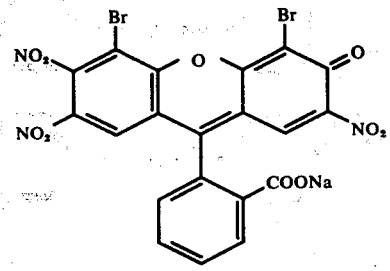

Compound IV-5

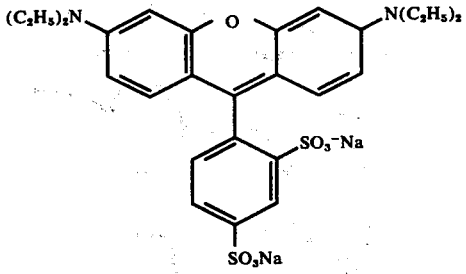

Compound V-1

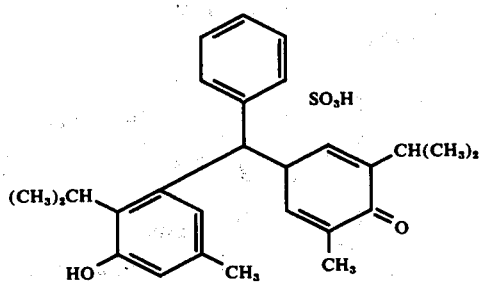

Compound V-2

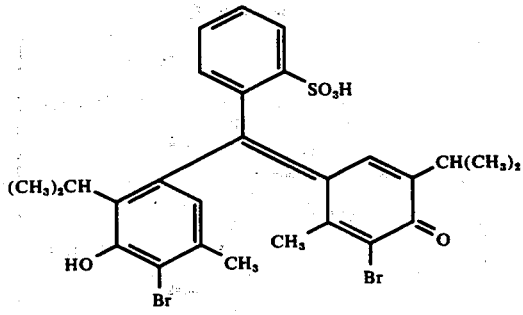

Compound V-3

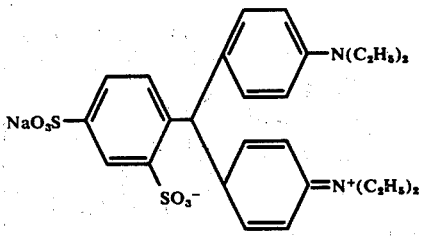

Compound V-4

-continued
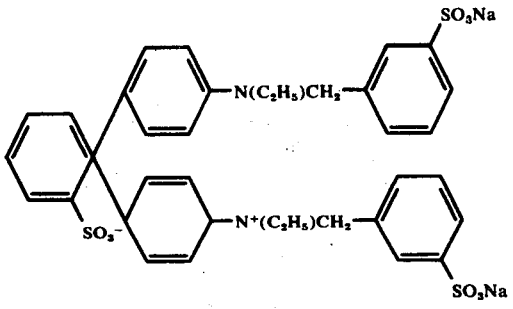
Compound V-5
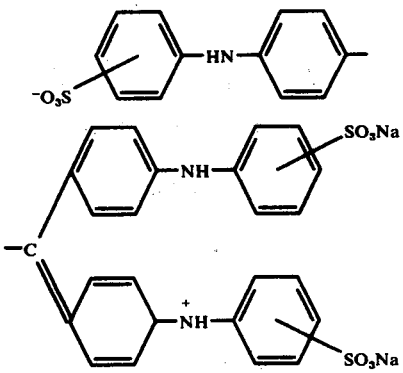
Compound V-6
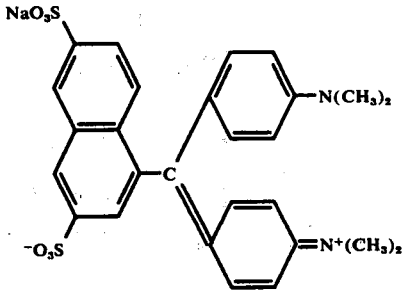
Compound V-7
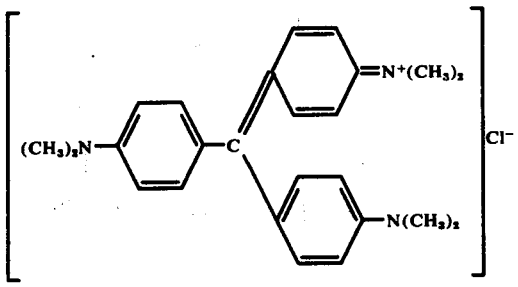
Compound V-8
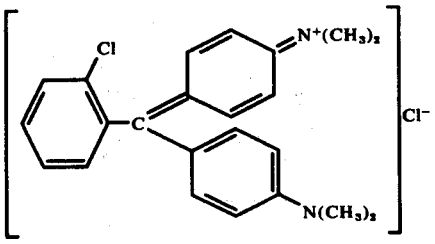
Compound V-9
-continued
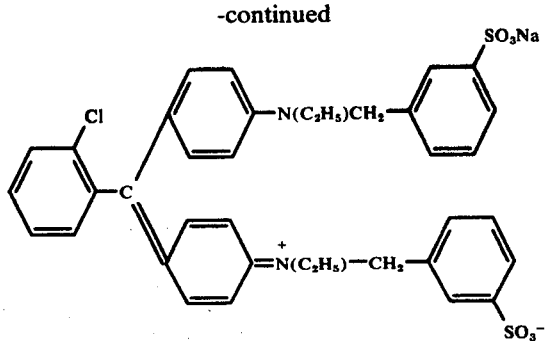
Compound VI-1
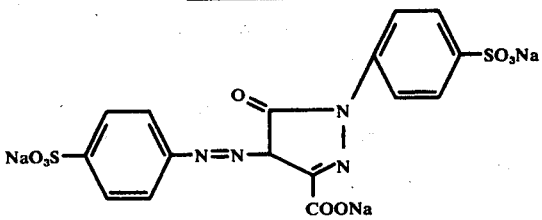
Compound VI-2
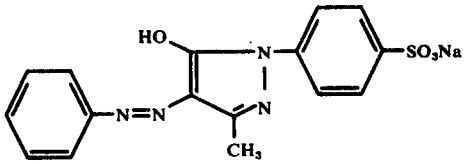
Compound VI-3
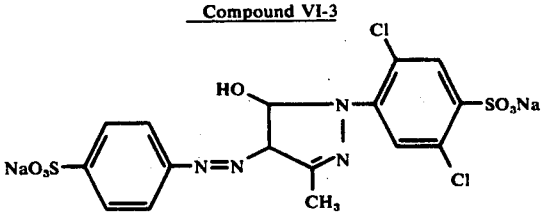
Compound VI-4
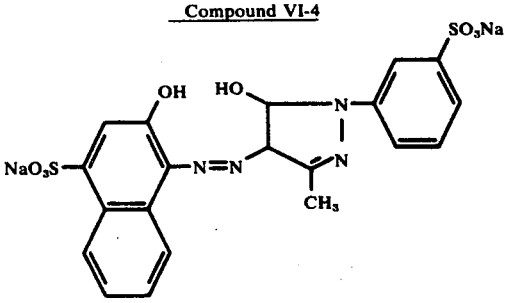
Compound VI-5
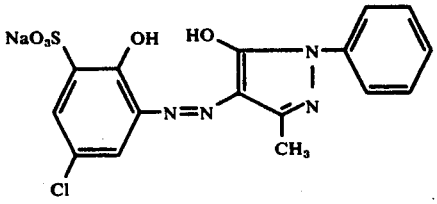
Compound VI-6
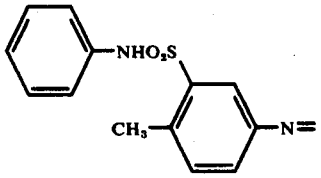

-continued

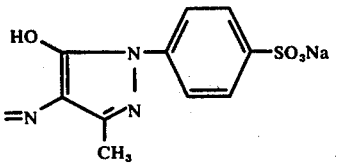

Compound VII-1

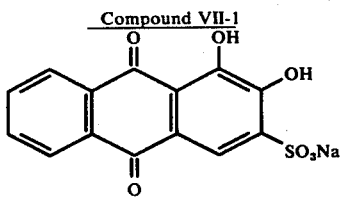

Compound VII-2

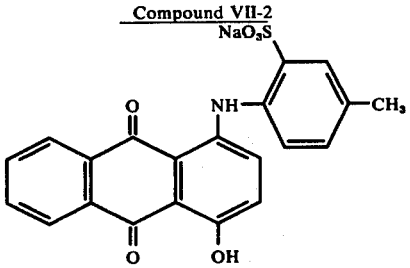

Compound VII-3

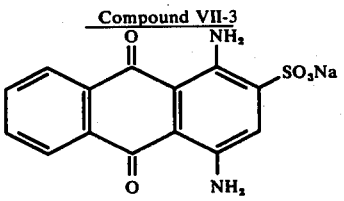

Compound VII-4

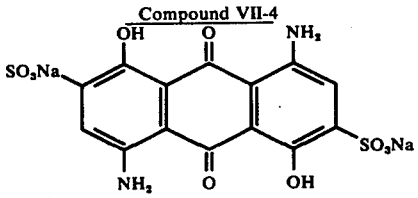

Compound VII-5

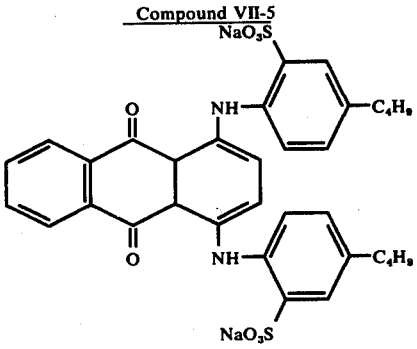

Other examples of acid dyes are dyes represented by the following formula (VIII)

(VIII)

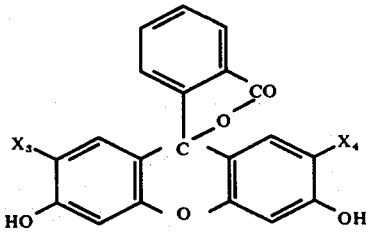

wherein $X_3$ and $X_4$ each represents a chlorine atom, a bromine atom, an iodine atom or an alkyl group.

Specific examples of dyes of the formula (VIII) are as follows.

Compound VIII-1

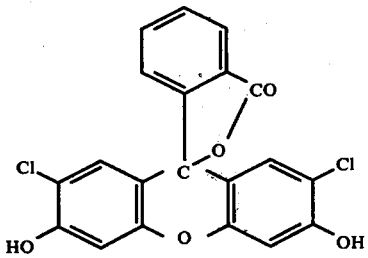

Compound VIII-2

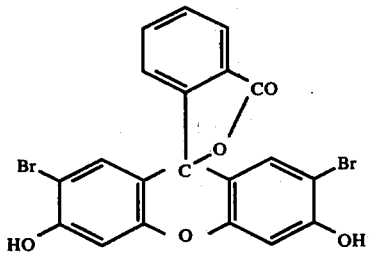

Compound VIII-3

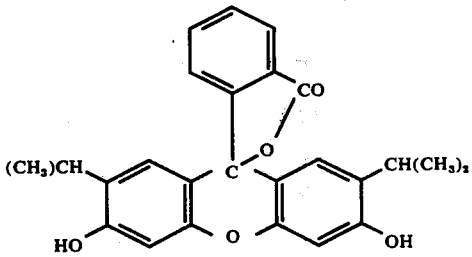

Compound VIII-4

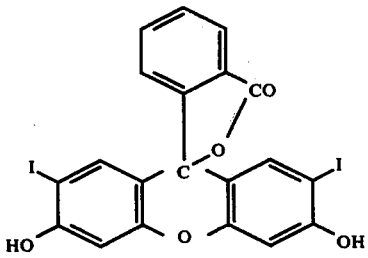

Compound VIII-5

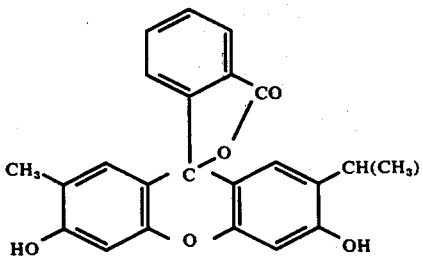

Additional examples of the acid dyes are dyes represented by the following formulae (IX) and (X)

$$Ar_6 - N = N - Ar_7 \quad \text{(IX)}$$

$$Ar_8 - N = N - Ar_9 - N = N - Ar_{10} \quad \text{(X)}$$

wherein, $Ar_6$, $Ar_7$, $Ar_8$ and $Ar_{10}$ each represents an aryl group, $Ar_9$ represents an arylene group, with at least one of $Ar_6$ and $Ar_7$ and at least one of $Ar_8$, $Ar_9$ and $Ar_{10}$ having a $SO_3M$ or COOM group wherein M represents a hydrogen atom, an alkali metal atom, an alkaline earth metal atom or $NH_4$, as a substituent. Dyes of the formulas (IX) and (X) are disclosed in German Pat. No. (OLS) 2,401,982.

Specific examples of such acid dyes are as follows.

Compound IX-1

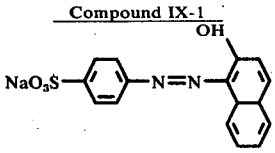

Compound IX-2

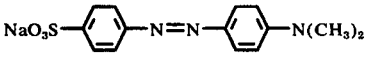

Compound IX-3

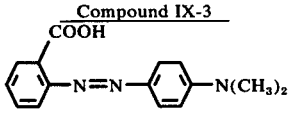

Compound IX-4

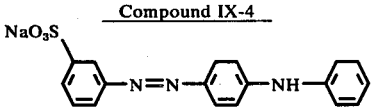

Compound IX-5

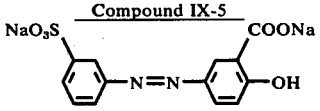

Compound IX-6

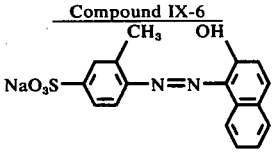

Compound IX-7

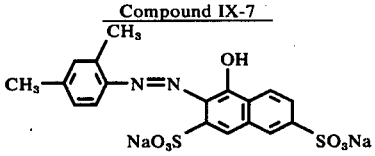

Compound X-1

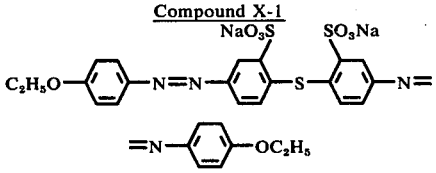

Compound X-2

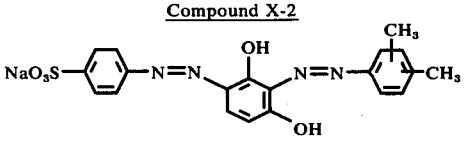

Compound X-3

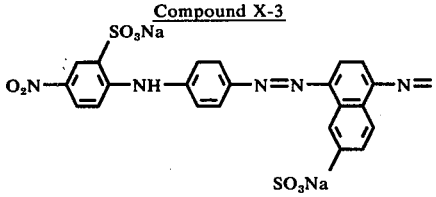

-continued

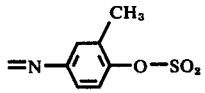

Compound X-4

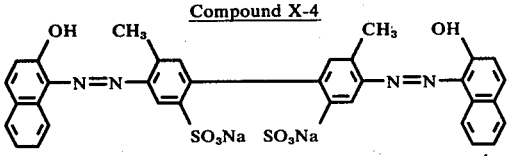

Compound X-5

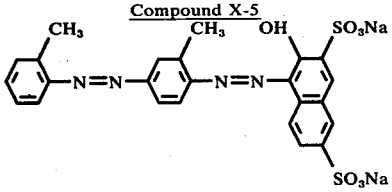

Compound X-6

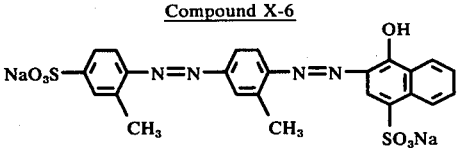

Compound X-7

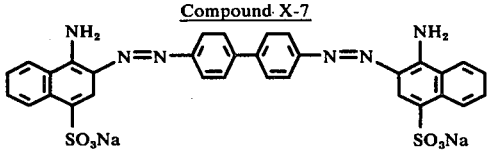

Compound X-8

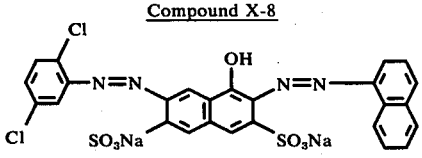

Compound IX-8

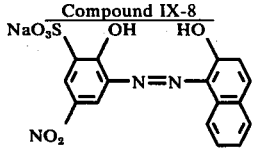

Compound IX-9

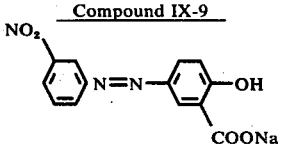

Compound IX-10

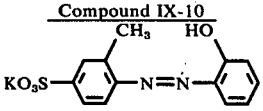

Compound IX-11

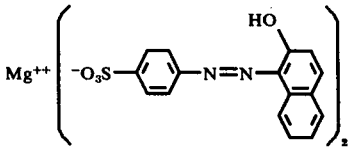

The heat developable photosensitive layers can contain various additives, for example, anti-heat-fogging agents such as N-bromosuccinimide, N-chlorosuccinimide, N-iodosuccinimide and the N-haloimides as described in Japanese Patent Application 8194/1973, blackening toning agents such as phthalazinone, phthalazinone derivatives, phthalimides and oxazinediones, stabilizers (compounds which prevent discoloration of the images on lapse of time after image formation) such as benzene sulfonic acid, p-toluene sulfonic acid, bromoterephthalic acid and bromoterephthalic acid anhydride, and antifogging agents such as benzotriazole and derivatives thereof or 1-phenyl-5-mercaptotetrazole. Further, fatty acids having 10 or more carbon atoms such as capric acid, lauric acid, myristic acid, palmitic acid, stearic acid, arachidic acid, behenic acid, cerotic acid and particularly fatty acids having a large number of carbon atoms than palmitic acid are preferably employed in order to prevent discoloration of the white areas of the sensitive material which was subjected to heat development processing, when exposed to white light.

Further, a top-coat polymer layer can be provided on the photosensitive layers, if desired, in order to increase the transparency of the heat-developable photosensitive layer, to increase image density and to improve raw storability (i.e., to preserve the photographic properties which the photosensitive material had just after production on storage preservation). A preferred thickness of the top coat polymer layer is about 1 micron to 20 microns. Examples of the polymers include polyvinyl chloride, polyvinyl acetate, copolymers of vinyl chloride and vinyl acetate, polyvinyl butyral, polystyrene, poly-methyl methacrylate, polyurethane, xylene resins, benzyl celluiose, ethyl cellulose, cellulose acetate butyrate, cellulose diacetate, cellulose triacetate, polyvinylidene chloride, chlorinated polypropylene, polyvinylpyrrolidone, cellulose propionate, polyvinyl formal, cellulose acetate phthalate, polycarbonate and cellulose acetate propionate, etc.

The top coat polymer layer further preferably contains a material such as kaolin or silica (silicon dioxide), because the material can be written on with a ball-point pen or a pencil after image formation.

Furthermore, the top coat polymer layer can contain ultraviolet ray absorbing agents or higher fatty acids.

Many kinds of materials can be used as the support. Typical examples of supports include cellulose nitrate films, cellulose ester films, polyvinyl acetal films, polystyrene films, polyethylene terephthalate films, polycarbonate films, other resin materials, glass, paper and metals, etc. As a support paper, a paper containing at least clay is preferred. Further, styrene-butadiene rubbers or polysaccharides can be present therein.

The above described heat-developable photosensitive materials can be developed by simply heating after exposure to light from a light source such as a xenon lamp or a mercury lamp. A suitable temperature at heating is about 80° C to 180° C and preferably 100° C to 150° C. A higher or lower temperature within the above described range can be used by appropriately prolonging or shortening the heating time. A suitable development time is generally about 1 second to 60 seconds.

Many heating means can be utilized for heat developing the photosensitive materials of the present invention, for example, the photosensitive materials can be contacted with a simple heated plate or contacted with a heated drum, or they can be passed through a heated atmosphere. Further, they can be heated using high frequency or a laser beam.

The heat-developable photosensitive materials according to the present invention have particularly a low heat-fogging property and low residual color.

The present invention will be further illustrated by reference to the following examples. Unless otherwise indicated, all parts, percents, ratios and the like are by weight.

EXAMPLE 1

0.95 g of sodium hydroxide was dissolved in 100 ml of water and then 5.0 g of lauric acid was dissolved therein by heating. After cooling to room temperature (i.e., about 20 to 30° C), a solution of 1 g of lauric acid in 50 ml of toluene was added thereto. Then, 50 ml of an aqueous solution of 4.4 g of silver nitrate and 25 ml of an aqueous solution of 0.075 g of ammonium bromide were added thereto at the same time while stirring the mixture with a stirrer. Thus the mixture was separated into an oily phase of silver laurate (silver bromide as the silver halide catalyst of Component (b) is formed at the same time) and an aqueous phase containing water soluble ions. The aqueous phase was removed by decantation. 5 g of the resulting silver laurate (+ silver bromide) and 3.0 g of polyvinyl butyral were added to 20 ml of isopropyl alcohol and the mixture was dispersed using a ball mill to produce a polymer dispersion of the silver salt.

To 20 g of this polymer dispersion of the silver salt, 30 ml of isopropyl alcohol was added. Then 2 ml of a 2.5% aqueous solution of hydrogen peroxide was added thereto. After stirring the dispersion for 5 minutes, materials of the following Composition (I) were added in turn to produce a heat-developable photosensitive coating solution. This coating solution was applied to a support in a coverage of 0.5 g of silver per 1 $m^2$ of the support to produce a heat-developable Photosensitive Material (A). For the purposes of comparison, a heat-developable Photosensitive Material (B) was produced from Composition (I) but hydrogen peroxide was not added.

| Composition (I) | |
|---|---|
| Dye * (0.025 wt% methyl Cellosolve solution) | 2 ml |
| Phthalazinone (3 wt% methyl Cellosolve solution) (toning agent) | 6 ml |
| 2,2-bis-(3,5-Dimethyl-4-hydroxyphenyl)-propane (20 wt.% acetone solution) | 5 ml |

*

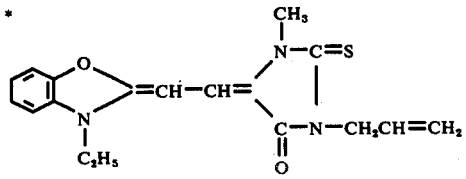

After exposing these two photosensitive materials to light through an original having gradation using a tungsten lamp, the materials were heated to 120° C for 30 seconds. Heat-fogging, that is, the reflection density, of the area which was not substantially exposed to light was 0.25 in Photosensitive Material (A), while it was 0.65 in Photosensitive Material (B). Namely, it was possible to substantially inhibit heat fogging by addition of the aqueous solution of hydrogen peroxide. The maximum density, that is, the black density of the area which was substantially exposed, and the photographic sensitivity of each sample were substantially equal.

EXAMPLE 2

30 ml of isopropyl alcohol was added to 20 g of a polymer dispersion of a silver salt prepared as in Example 1. Then, 1 ml of a 0.04% aqueous solution of ammonium peroxodisulfate was added thereto. After stirring the mixture for 10 minutes, materials as described in Composition (I) of Example 1 were added thereto to produce a heat-developable photosensitive coating solution. This coating solution was then applied to a support in a coverage of 0.5 g of silver per 1 $m^2$ of the support to produce heat-developable Photosensitive Material (C).

This Photosensitive Material (C) and a Photosensitive Material (B) prepared as in Example 1 were exposed to light through an original having gradation using a tungsten lamp, and the materials were developed by heating to 120° C for 20 seconds. Thus, images having a high contrast were obtained in each material. In Photosensitive Material (B), heat fogging occurred in the nonexposed area, that is, the background, and Photosensitive Material (B) becomes slightly black. The reflection density thereof was 0.5. Further, a light pink residual color of the dye was present. In Photosensitive Material (C) wherein ammonium peroxodisulfate had been added, heat fog in the non-exposed area was remarkably decreased and the reflection density was 0.25. Further no residual color of the dye was observed at all and thus Photosensitive Material (C) having good whiteness was obtained.

EXAMPLE 3

30 ml of isopropyl alcohol was added to 20 g of a polymer dispersion of a silver salt prepared as in Example 1. Then 2 ml of a 0.04% aqueous solution of ammonium peroxodisulfate was added thereto. After stirring the mixture for 10 minutes, the materials of Composition (I) as described in Example 1 were added thereto to produce a heat-developable photosensitive coating solution. The coating solution was then applied to a support in a coverage of 0.5 g of silver per $m^2$ of the support to produce heat developable Photosensitive Material (D).

When this Photosensitive Material (D) was exposed to light and developed in the same manner as in Example 2, the same photographic properties as in Photosensitive Material (C) were obtained, that is, the heat fog decreased from 0.50 to 0.25 as reflection density, and the residual color of the dye was removed.

EXAMPLE 4

1.9 g of sodium hydroxide was dissolved in 200 ml of water. To this solution, a solution of 12 g of lauric acid in 100 ml of toluene was added and the mixture was emulsified by stirring by with a stirrer. To this emulsion, an aqueous solution of silver nitrate (silver nitrate: 8.5 g, wafer: 50 cc) was added over a 60 second period while stirring the emulsion (800 r.p.m.; 5 minutes) to produce silver laurate. The precipitated silver laurate was removed and mixed with 30 g of polyvinyl butyral and 200 ml of isopropyl alcohol. The mixture was dispersed using of a ball mill to produce a polymer dispersion of the silver salt.

To 20 g of this polymer dispersion, 3 ml of a 1.1 wt.% methanol solution of N-bromosuccinimide was added, and the mixture was stirred for 90 minutes at 50° C, by which AgBr formed. To this solution, 30 ml of isopropyl alcohol was added and then 2.5 ml of a 0.02 wt% aqueous solution of ammonium peroxodisulfate was added. The mixture was stirred for 10 minutes. Then materials of the following Composition (II) were added in turn to produce a heat-developable photosensitive coating solution.

This solution was applied to a support in a coverage of 0.4 g of silver per $m^2$ of the support to produce heat-developable Photosensitive Material (E).

For the purposes of comparison, heat-developable Photosensitive Material (F) was produced using Composition (II) but ammonium peroxodisulfate was not added.

| Composition (II) | |
|---|---|
| Dye * | |
| (0.025 wt.% methyl Cellosolve solution) | 2 ml |
| Phthalazinone (3 wt.% methanol solution) | 6 ml |
| 2,2-bis-(3,5-Dimethyl-4-hydroxyphenyl)-propane (20 wt.% acetone solution) | 5 ml |

*

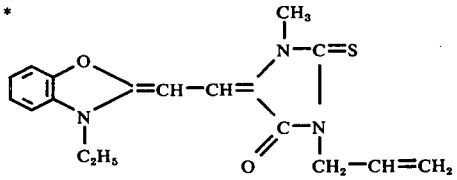

These two Photosensitive Materials (E) and (F) were exposed to light through an original having gradation using a tungsten lamp and developed by heating to 120° C for 40 seconds. In all cases, images having a high contrast were obtained. In Photosensitive Material (F) wherein ammonium peroxodisulfate had not been added, heat fog appeared in the non-exposed area, that is, the background, and the non-exposed area became slightly black (reflection density: 0.45) and a light pink residual color of the dye was present. However, in Photosensitive Material (E), heat fogging decreased (reflection density: 0.25) the pink residual color of the dye disappeared and whiteness was remarkably improved.

EXAMPLE 5

In heat-developable Photosensitive Material (G) which was obtained by the same manner as for heat-developable Photosensitive Material (E) of Example 4, but 1 ml of a 2% aqueous solution of hydrogen peroxide was employed instead of the ammonium peroxodisulfate, the same photographic properties as for Photosensitive Material (E) were obtained.

EXAMPLE 6

3.4 g of silver behenate was dissolved in 100 ml of toluene at 60° C. 100 ml of a diluted aqueous solution of nitric acid having a pH of 2.0 (25° C) was mixed with this solution while stirring the solution with a stirrer. The mixture was stirred at 60° C and 100 ml of an aqueous solution of silver ammonium complex salt which was prepared by adding an ammonia solution to about 80 ml of an aqueous solution containing 1.7 g of silver nitrate and adding water to make the total volume 100 ml and then 50 ml of an aqueous solution containing 0.047 g of ammonium bromide and 0.001 g of ammonium iodide were added thereto at the same time while stirring the solution. Thus silver behenate and silver iodobromide were formed at the same time. When the reaction product was allowed to stand for 20 minutes at room temperature, it separated into an aqueous phase and a toluene phase. After removal of the aqueous phase, the toluene phase was washed with 400 ml of fresh water by decantation. This washing treatment was repeated three times. Then 400 ml of water was added thereto and silver behenate - silver iodobromide was separated by centrifugal separation. Thus 4 g of a mixture wherein spindle shaped silver behenate crystals having a length of about 1 micron and a diameter of about 0.05 microns contacted with silver iodobromide was produced. 2.5 g of this silver behenate-silver iodobromide mixture was added to 20 ml of an isopropyl alcohol solution containing 2 g of polyvinyl butyral and the mixture was ball milled for 1 hour to produce a polymer dispersion.

To 20 ml of this polymer dispersion, 2 ml of a 0.04 wt.% aqueous solution of ammonium peroxodisulfate was added. The mixture was stirred for 10 minutes. Then, materials of the following Composition (III) were added thereto to produce a heat-developable photosensitive coating solution. This solution was then applied to a support paper at a coverage of 1.5 g of silver per $m^2$ of the support to produce heat-developable Photosensitive Material (H).

For the purposes of comparison, heat-developable Photosensitive Material (I) was produced using Composition (III) in the same manner as in Photosensitive Material (H) but ammonium peroxodisulfate was not employed.

Composition (III)

| | |
|---|---|
| Dye * (0.025 wt.% methyl Cellosolve solution) | 2 ml |
| Phthalazinone (3 wt.% methyl Cellosolve solution) | 6 ml |
| 2,2'-Methylene-bis-(6-t-butyl-4-methyl-phenol) (25 wt.% methyl Cellosolve solution) | 3 ml |
| Tetrachlorophthalic Acid Anhydride (0.6 wt.% methanol solution) | 1 ml |
| Behenic Acid (3 wt.% methyl Cellosolve solution) | 5 ml |

*

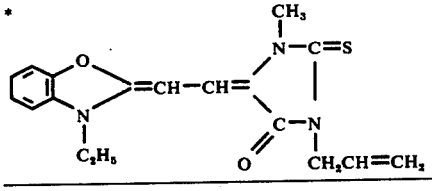

As the result of the same evaluation as in Example 2, heat fog (reflection density: 0.55) and the pink residual color of the dye in the non-exposed area occurred in the case of Photo-sensitive Material (I) wherein ammonium peroxodisulfate was not used. On the contrary, in Photosensitive Material (H), heat fog (reflection density: 0.25) and the pink residual color of the dye decreased and the whiteness increased.

EXAMPLE 7

6 g of benzotriazole was dissolved in 100 ml of isoamyl acetate and the solution was cooled to −15° C. To this solution a solution produced by dissolving 8.5 g of silver nitrate in 100 ml of a diluted aqueous nitric acid solution having a pH of 2.0 (25° C) at 3° C was added with stirring with a stirrer. Thus a dispersion containing microcrystals of silver benzotriazole was obtained. When this dispersion was allowed to stand for 20 minutes at room temperature, the dispersion separated into an aqueous phase and an isoamyl acetate phase. The aqueous phase was removed first and then the isoamyl acetate phase was washed with 400 ml of fresh water by decantation. After this washing treatment had been repeated three times 400 ml of methanol was added thereto and silver benzotriazole was separated by centrifugal separation. Thus, 8 g of silver benzotriazole was obtained. The silver benzotriazole particles were globular in shape and had a diameter of about 1 micron. 2.5 g of this silver benzotriazole was added to 4 ml of an ispropyl alcohol containing 4 g of polyvinyl butyral and the mixture was dispersed for 4 hours using a ball mill to produce a polymer dispersion of the silver salt.

To 40 ml of this polymer dispersion of the silver salt, 2 ml of a 0.04 wt% aqueous solution of ammonium peroxodisulfate was added and the mixture was stirred for 10 minutes. Then the materials of the following Composition (IV) were added thereto to produce a heat-developable photosensitive coating solution. This solution was applied to a paper support at a coverage of 1.2 g of silver per $m^2$ of the support to produce heat-developable Photosensitive Material (J).

Composition (IV)

| | |
|---|---|
| Dye * (0.025 wt.% methyl Cellosolve solution) | 2 ml |
| Ammonium Iodide (8.5 wt.% methanol solution) | 1 ml |
| Solution of Ascorbic Acid Mono-palmitate (2 g) and Ascorbic Dipalmitate(2 g) in Methyl Cellosolve (10 ml) | 10 ml |
| N-Ethyl-N'-Dodecylurea (2.5 wt.% methyl Cellosolve solution) | 2 ml |

*

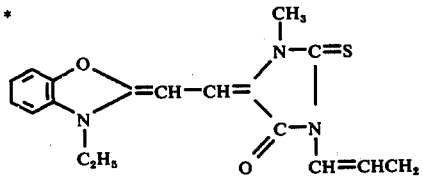

On the other hand, heat developable Photosensitive Material (K) wherein ammonium peroxodisulfate was not employed was produced for the purposes of comparison.

To the photosensitive layers of Photosensitive Materials (J) and (K), a 15 wt.% tetrahydrofuran solution of a vinyl chloride-vinyl acetate copolymer (copolymer composed of 95% by weight of vinyl chloride and 5% by weight of vinyl acetate) was applied in a dry film thickness of 8 $\mu$.

As the result of the same evaluation as in Example 2, good images were obtained with both of Photosensitive Materials (J) and (K). In Photosensitive Material (J) wherein ammonium peroxodisulfate had been employed, a small amount of heat fog was formed in the nonexposed area. Further, no pink residual color of the dye was present and the whiteness was very high.

EXAMPLE 8

A solution of 8.6 g of capric acid in 100 ml of butyl acetate was kept to 5° C. To this solution, 50 ml of hydrobromic acid (0.4% aqueous solution) was added with stirring to emulsify. To this emulsion, 50 ml of an aqueous solution of silver ammonium complex salt containing 8.5 g of silver nitrate (cooled to 5° C) was added over a 30 second period to react the capric acid and the hydrogen bromide with silver ions at the same time. After removal of the aqueous phase, the butyl acetate phase obtained containing both of the silver salts was dispersed in 120 g of a 15 wt% isopropanol solution of polyvinyl butyral to produce a polymer dispersion of the silver salt.

To this polymer dispersion of the silver salt, 10 ml of a 0.04 wt% aqueous solution of potassium peroxodisulfate was added and the mixture was stirred for 10 minutes. Then, materials of the following Composition (V) were added in turn to produce a heat-developable photosensitive coating solution.

| Composition (V) | |
|---|---|
| Ammonium Bromide (2.5 wt.% methanol solution) | 24 ml |
| Dye * (0.025 wt% methyl Cellosolve solution) | 20 ml |
| Phthalazinone (3 wt.% methyl Cellosolve solution) | 60 ml |
| Bisphenol A (70 wt.% methyl Cellosolve solution) | 72 ml |

*

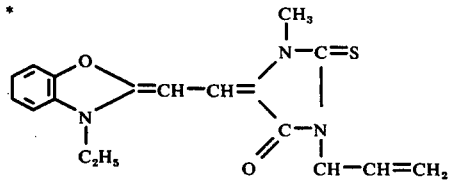

This coating solution was applied to a paper support at a coverage of 1.0 g of silver per $m^2$ of the support to produce heat-developable Photosensitive Material (L). For the purposes of comparison, Photosensitive Material (M) was produced by adding Composition (V) but potassium peroxodisulfate was not employed. As the result of the same evaluation as in Example 2, images having a high contrast were obtained in each case. But in Photosensitive Material (L) containing the potassium peroxodisulfate, the formation of heat fog was slight, little pink residual color of the dye remained and the whiteness was high as compared with Photosensitive Material (M).

EXAMPLE 9

Sodium peroxide was used instead of hydrogen peroxide in Example 1. Because sodium peroxide violently reacts with water at room temperature, a 5% solution of sodium peroxide was prepared using cold water at 5° C. 2 ml of this solution was added to the polymer dispersion as described in Example 1. Heat-developable Photosensitive Material (N) was produced in the same manner as in Example 1.

This Photosensitive Material (N) and a Photosensitive Material (B) prepared as described in Example 1 wherein the cold aqueous solution of sodium peroxide had not been employed were exposed to light through an original having gradation using a tungsten lamp and developed by heating to 120° C for 25 seconds.

In Photosensitive Material (N), the reflection density of the non-exposed area was 0.25, while the reflection density was 0.55 in Photosensitive Material (B). Namely, formation of heat fog was substantially inhibited by the addition of the aqueous solution of sodium peroxide. Other photographic properties, maximum density and sensitivity of each material were substantially the same.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material comprising a support having thereon one or more layers with at least one of the layers containing at least one of (a) an organic silver salt, (b) a catalytic amount of a photosensitive silver halide or a component capable of forming a photosensitive silver halide and (c) a reducing agent, and (d) at least one of an inorganic peroxide and a peroxodisulfate wherein the amount of said inorganic peroxide is about 0.001 to 50 moles per mole of said organic silver salt of component (a) and wherein the amount of said peroxodisulfate is about $10^{-6}$ to $10^{-2}$ moles per mole of said organic silver salt of component (a).

2. The heat-developable photosensitive material of claim 1, wherein said inorganic peroxide is represented by the formula $$M'_2O_2$$

wherein $M^I$ is a hydrogen atom, a lithium atom, a sodium atom, a potassium atom, a rubidium atom, a cesium atom or an ammonium group or by the formula $$M^{II}O_2$$

wherein $M^{II}$ is a magnesium atom, a calcium atom, a strontium atom, a barium atom, a zinc atom, a cadmium atom or a mercury atom.

3. The heat-developable photosensitive material of claim 1, wherein said peroxodisulfate is represented by the formula $$M''_2S_2O_8$$

wherein $M'^I$ is a hydrogen atom, a lithium atom, a potassium atom, a rubidium atom or an ammonium group or is barium peroxodisulfate or lead peroxodisulfate.

4. The heat-developable photosensitive material of claim 1, wherein said inorganic peroxide is hydrogen peroxide.

5. The heat-developable photosensitive material of claim 3, wherein $M'^I$ is a hydrogen atom, a sodium atom, a potassium atom, or an ammonium group.

6. The heat-developable photosensitive material of claim 1, wherein said organic silver salt of component (a) is a silver salt of an organic compound containing an imino group, a mercapto group, a hydroxyl group, or a carboxyl group.

7. The heat-developable photosensitive material of claim 6, wherein said organic silver salt of component (a) is a silver carboxylate.

8. The heat-developable photosensitive material of claim 1, wherein said photosensitive silver halide is silver chloride, silver bromide, silver bromochloride, silver iodobromide, silver iodobromochloride or silver iodide.

9. The heat-developable photosensitive material of claim 1, wherein said component capable of forming a photosensitive silver halide is an inorganic compound represented by the formula $$MX_n$$

wherein M represents a hydrogen atom, an ammonium group, or a metal atom, X represents a halogen atom, and n is 1 where M is a hydrogen atom or an ammonium group, or n is the valency of the metal when M is a metal atom, or an organic halogen compound selected from the group consisting of triphenylmethyl chloride, triphenylmethyl bromide, 2-bromo-2-methylpropane, 2-bromobutyric acid, 2-bromoethanol, dichlorobenzophenone, iodoform, bromoform, carbon tetrabromide, an N-halosuccinimide, an N-haloacetamide, 1,3-dibromo-5,5-dimethylthiohydantoin, 1,3-dichloro-5,5-dimethylthiohydantoin or an ammonium halide.

10. The heat-developable photosensitive material of claim 1, wherein said reducing agent is a monohydroxybenzene, a dihydroxybiphenyl, a di- or polyhydroxybenzene, a naphthol, a naphthylamine, an aminonaphthol, a hydroxybinaphthyl, an aminophenol, a p-phenylenediamine, an alkylene-bisphenol, ascorbic acid or a derivative thereof, or a pyrazolidone.

11. The heat-developable photosensitive material of claim 1, wherein said material comprises a support having thereon at least one layer containing said components (a) to (d).

12. The heat-developable photosensitive material of claim 1 wherein said component (d) is an inorganic peroxide.

13. The heat-developable photosensitive material of claim 1 wherein said component (d) is a peroxodisulfate.

14. The heat-developable photosensitive material of claim 1, including a spectral sensitizing dye.

15. The heat-developable photosensitive material of claim 14, wherein said spectral sensitizing dye is a rhodacyanine dye, a styryl dye, a merocyanine dye, or an acid dye.

* * * * *